US008662142B2

(12) United States Patent
Biebricher et al.

(10) Patent No.: US 8,662,142 B2
(45) Date of Patent: Mar. 4, 2014

(54) METHOD AND DEVICE FOR REMELTING METAL IN AN ELECTRIC FURNACE

(75) Inventors: Ulrich Biebricher, Niddatal (DE); Michael Protzmann, Wachtersbach (DE); Gerhard Brückmann, Asslar (DE)

(73) Assignee: Ald Vacuum Technologies GmbH (DE)

( * ) Notice: Subject to any disclaimer, the term of this patent is extended or adjusted under 35 U.S.C. 154(b) by 0 days.

(21) Appl. No.: 13/375,422

(22) PCT Filed: Jun. 11, 2010

(86) PCT No.: PCT/EP2010/058249

§ 371 (c)(1),
(2), (4) Date: Feb. 17, 2012

(87) PCT Pub. No.: WO2010/142791

PCT Pub. Date: Dec. 16, 2010

(65) Prior Publication Data

US 2012/0132385 A1 May 31, 2012

(30) Foreign Application Priority Data

Jun. 12, 2009 (DE) ..... 10 2009 025 176

(51) Int. Cl.

| | |
|---|---|
| ***B22D 27/04*** | (2006.01) |
| ***B22D 23/10*** | (2006.01) |
| ***C22B 9/18*** | (2006.01) |

(52) U.S. Cl.
USPC ..... 164/122; 164/124; 164/492; 164/250.1; 164/515; 75/10.24

(58) Field of Classification Search
USPC ..... 164/122, 124, 335, 250.1, 492, 509, 164/515; 75/10.24; 373/42, 45
See application file for complete search history.

(56) References Cited

U.S. PATENT DOCUMENTS 6,309,441 B1 * 10/2001 Benz et al. ..... 75/10.46

FOREIGN PATENT DOCUMENTS

| | | | | |
|---|---|---|---|---|
| FR | 2584321 | | 1/1987 | |
| JP | S5564957 | A | 5/1980 | |
| JP | H07188795 | A | 7/1995 | |
| JP | H0929420 | A | 2/1997 | |
| WO | WO 86/06415 | A1 * | 11/1986 | ..... C22B 9/18 |

OTHER PUBLICATIONS

Abstract (front page) of GB 2 186 826 A, published Aug. 16, 1987.*
Machine translation of WO 86/06415 A1 (8 pages).*
PCT, English Translation of the International Preliminary Report on Patentability, International Application No. PCT/EP2010/058249, Dec. 22, 2011.
The International Search Report as mailed on Aug. 25, 2010 for International Application No. PCT/EP2010/058249.
Japanese Patent Office, Notice of Grounds of Rejection, Application No. 2012-514484, Oct. 29, 2013.

* cited by examiner

*Primary Examiner* — Kevin P Kerns
(74) *Attorney, Agent, or Firm* — Quarles & Brady LLP

(57) ABSTRACT

A method and a device for remelting metal in an electric furnace includes forming a slag bath to form molten material electrodes. The molten metal of the material electrodes solidifies in block form in a crucible apparatus as a result of cooling in such a way that a block growth forms from a block base using a progressing solidification process, wherein the block base is heated by applying energy directly to the block base to influence the cooling process.

18 Claims, 3 Drawing Sheets

METHOD AND DEVICE FOR REMELTING METAL IN AN ELECTRIC FURNACE

CROSS REFERENCE TO RELATED APPLICATION

The present application claims the benefit of German Patent Application No. 10 2009 025 176.6 filed Jun. 12, 2009, and represents the national stage entry of PCT International Application No. PCT/DE2010/058249 filed on Jun. 11, 2010, both applications are fully incorporated herein by reference.

STATEMENT REGARDING FEDERALLY SPONSORED RESEARCH OR DEVELOPMENT

Not applicable.

FIELD OF THE INVENTION

The invention pertains to a method for remelting metal in an electric furnace, wherein material electrodes are molten by forming a slag bath and the molten metal of the material electrodes solidifies in ingot form in a crucible apparatus as a result of cooling in such a way that an ingot growth forms from an ingot base due to a progressive solidification process, wherein the ingot base is heated in order to influence the cooling process. The invention furthermore pertains to a device for heating an ingot base during the remelting of metal in an electric furnace.

BACKGROUND OF THE INVENTION

In electroslag remelting processes, material electrodes are remolten in order to produce material ingots, wherein the latter are used as semifinished products for the manufacture of components with high material quality such as, for example, forgings for use in power plants that have to meet the strictest reliability requirements. With respect to the systems or methods used, one distinguishes between two systems, the first of which is the so-called sliding crucible or ingot retraction system, in which the crucible apparatus, in which the ingots produced by melting the electrodes solidify, is provided with a crucible bottom that can be displaced independently of or together with a crucible wall in order to effectively manufacture the ingots in the form of a continuous slab. In so-called stationary crucible systems, the material electrodes are remolten into an ingot that is defined with respect to its linear dimension, wherein the crucible apparatus used in this case features a fixed crucible bottom.

In order to control the course of the cooling process that is essential for the material quality of the ingot, particularly in the region of the ingot base formed by the lower end of the ingot, it is known to realize the crucible bottom of crucible apparatuses used in stationary crucible systems in a heatable fashion. In this case, a bottom plate of the crucible bottom that is in contact with the ingot is indirectly tempered. A heat transfer medium such as, for example, water or oil is used for the tempering process. Consequently, the ingot mass in the crucible is tempered indirectly because the heat transfer medium initially needs to be heated to the desired temperature by means of a suitable energy carrier before a heat transfer to the ingot base can be realized via the bottom plate of the crucible bottom. The known heating method therefore is relatively sluggish such that it is hardly possible, in particular, to achieve desired temperature profiles during the heating of the ingot base. In addition, shrinkage of the ingot base occurs, in particular, in the region of the ingot base surface such that the ingot base frequently is not in direct contact with the bottom plate over its entire surface area.

A particular problem also arises due to the fact that the bottom plate consists of copper or a copper alloy in order to realize an adequate heat transfer such that the temperature of the bottom plate is limited to about 200° C. due to its material. It therefore must be assumed that the conventional ingot base heating process merely makes it possible to achieve slight temperature gradients on the one hand and also a relatively small temperature increase of the ingot base on the other hand.

SUMMARY OF THE INVENTION

The invention therefore is based on the objective of proposing a method and a device for heating an ingot base that not only make it possible to achieve a higher temperature gradient, but also an increase of the maximally possible heating of the ingot base.

In the inventive method for remelting metal in an electric furnace, in which material electrodes are molten in order to form a slag bath and the molten metal of the material electrodes solidifies in ingot form in a crucible apparatus as a result of cooling in such a way that an ingot growth forms from an ingot base due to a progressive solidification process, the ingot base is heated in order to influence the solidification process by directly acting upon the ingot base with energy.

Such a direct energy application makes it possible to achieve a higher temperature gradient during the heating of the ingot base on the one hand and an increase of the maximally possible ingot base temperature on the other hand.

Consequently, the inventive method provides a much more effective option for influencing the progression of the solidification process during the ingot growth. This becomes even more evident if one takes into account that the solidification progresses due to the migration of a solid/liquid interface such that its distance from the ingot base increases. Consequently, a variation of the temperature level or the temperature profile in the region of the ingot base also makes it possible to influence the structural composition at a greater distance from the ingot base during the solidification of the ingot. The direct heating of the ingot base therefore also makes it possible to influence the microstructure of the ingot at locations that lie relatively far from the actual ingot base. This reflects the considerable significance of the inventive method.

The invention furthermore makes it possible to limit the minimal surface temperature in the region of the ingot base or a negative temperature gradient in order to counteract an undesirable formation of cracks in the ingot surface during the cooling process.

The invention can be utilized in an equally advantageous fashion in stationary crucible systems, as well as sliding crucible or ingot retraction systems, particularly if a face of the ingot base is directly acted upon.

According to a particularly advantageous variation of the inventive method, the ingot base is heated by acting upon the ingot base with a device that uses, for example, gas or oil as energy carrier. The particular advantage of such a burner device can be seen in that the burner temperature can be very precisely adjusted and that the burner temperature can be very quickly varied by simply regulating the supply of the energy carrier or the distance of the burner device from the ingot base.

If the ingot base is acted upon with electric energy in accordance with an alternative variation, it is particularly advantageous that a corresponding heating device can be realized in a very compact fashion and therefore also easily integrated into the crucible bottom, if so required. It would be possible, for example, to utilize an inductively heatable contact plate that is brought in contact with the face of the ingot base.

It would furthermore be possible to act upon the ingot base with a stream of a heat transfer medium in such a way that, for example, a heated fluid stream, i.e., air or water, is directly aimed at the ingot base.

It is particularly advantageous to heat the ingot base such that a defined temperature distribution is adjusted over the ingot base cross section and, for example, outer edge regions of the ingot base that cool faster than inner regions of the ingot base can be acted upon with a higher or lower temperature depending on the respective requirements.

If the ingot base is acted upon by means of a burner device, in particular, it may be advantageous to carry out the heating of the ingot base in a reduced atmosphere in order to prevent, for example, a carburization, surface oxidation or nitration of edge regions of the ingot base.

After a previous cooling or solidification of the ingot base, an initially closed crucible bottom can be opened in order to form an opening and to subsequently control the further cooling by directly heating the face.

In the inventive device for heating the ingot base of an ingot that solidifies in a crucible apparatus during an electroslag remelting process as a result of cooling a molten metal, the crucible apparatus features a casing wall and a crucible bottom that is provided with an opening in order to directly heat the ingot base by means of a heating device, namely in such a way that the heating energy generated by the heating device is directly introduced into the material of the ingot base.

The heating device may be realized in the form of a burner device or a contact device for introducing a current into the ingot base.

It would alternatively also be possible to realize the heating device in the form of a radiator in order to allow a contactless supply of heat into the ingot base.

If the heating device consists of a convection heater, for example, with a nozzle that aims a heated fluid stream at discretely defined areas of the ingot base, it would also be possible to utilize waste heat that is released at another location of the electroslag remelting processes or even independently thereof in the plant engineering section of a steel mill for realizing the heating device.

In order to allow, in particular, a selective utilization of the heating device on one and the same crucible apparatus, it is advantageous to realize the heating device independently of the crucible bottom.

The effectiveness of the heating device can be increased by arranging the heating device in a heating chamber that is situated adjacent to the crucible bottom, wherein a heating chamber in the form of a process chamber also makes it possible, in particular, to adjust a defined process atmosphere such as, for example, a reduced atmosphere within the heating chamber.

If the crucible apparatus is provided with an ingot base insulation in the region of the crucible bottom, the inventive device can be utilized in a particularly advantageous fashion in connection with a sliding crucible system, in which the ingot base generally cools faster and more intensely than in a stationary crucible system due to the partially great distance of the ingot base from the slag bath.

BRIEF DESCRIPTION OF THE DRAWINGS

A preferred variation of the method and a preferred embodiment of the device are described in greater detail below with reference to the drawings.

In these drawings.

DETAILED DESCRIPTION OF THE EXAMPLE EMBODIMENTS

Figure 1:
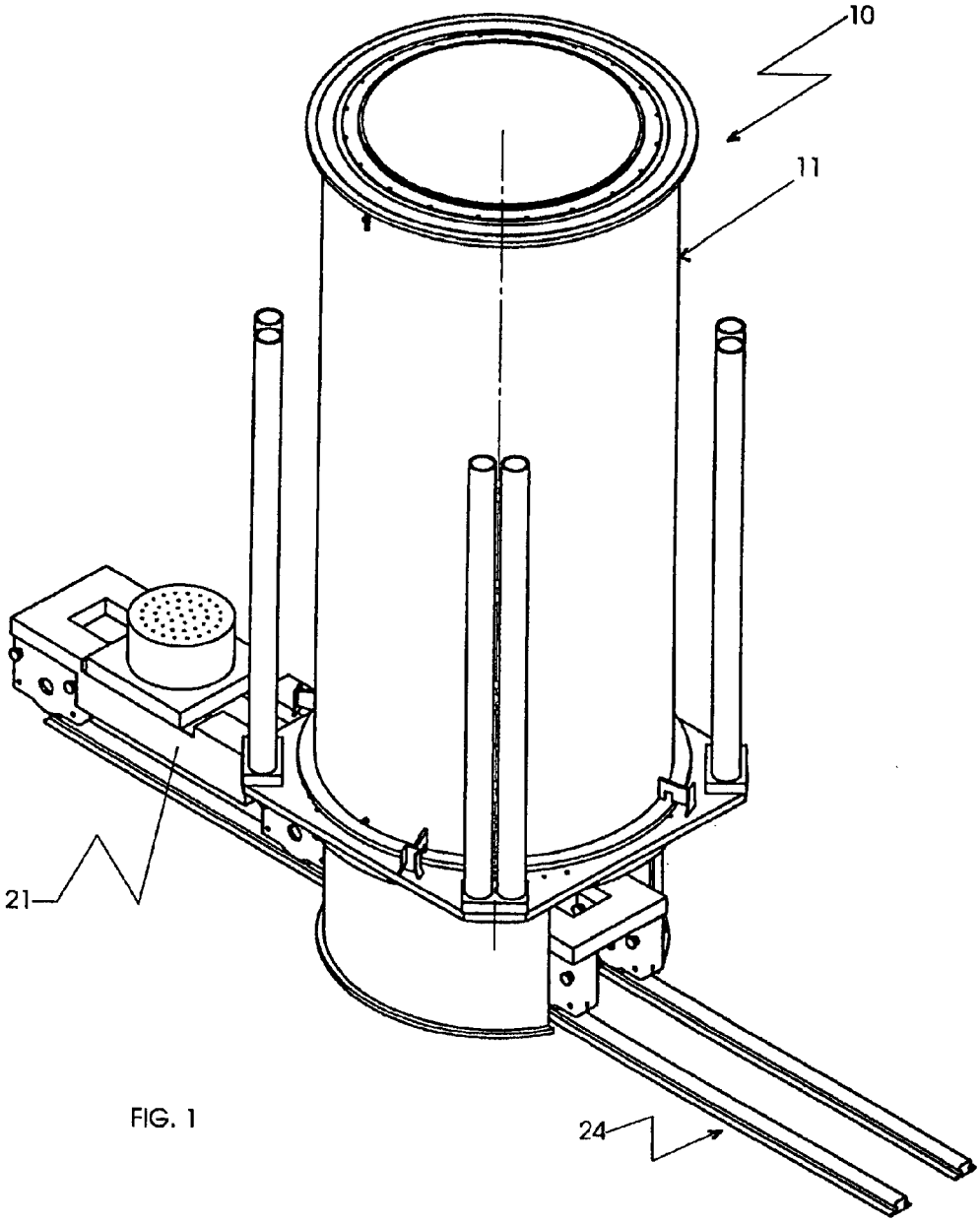
FIG. 1 shows an isometric representation of a crucible apparatus for a stationary crucible system with a changing device arranged on a crucible bottom during the cooling phase.
Figure 3:
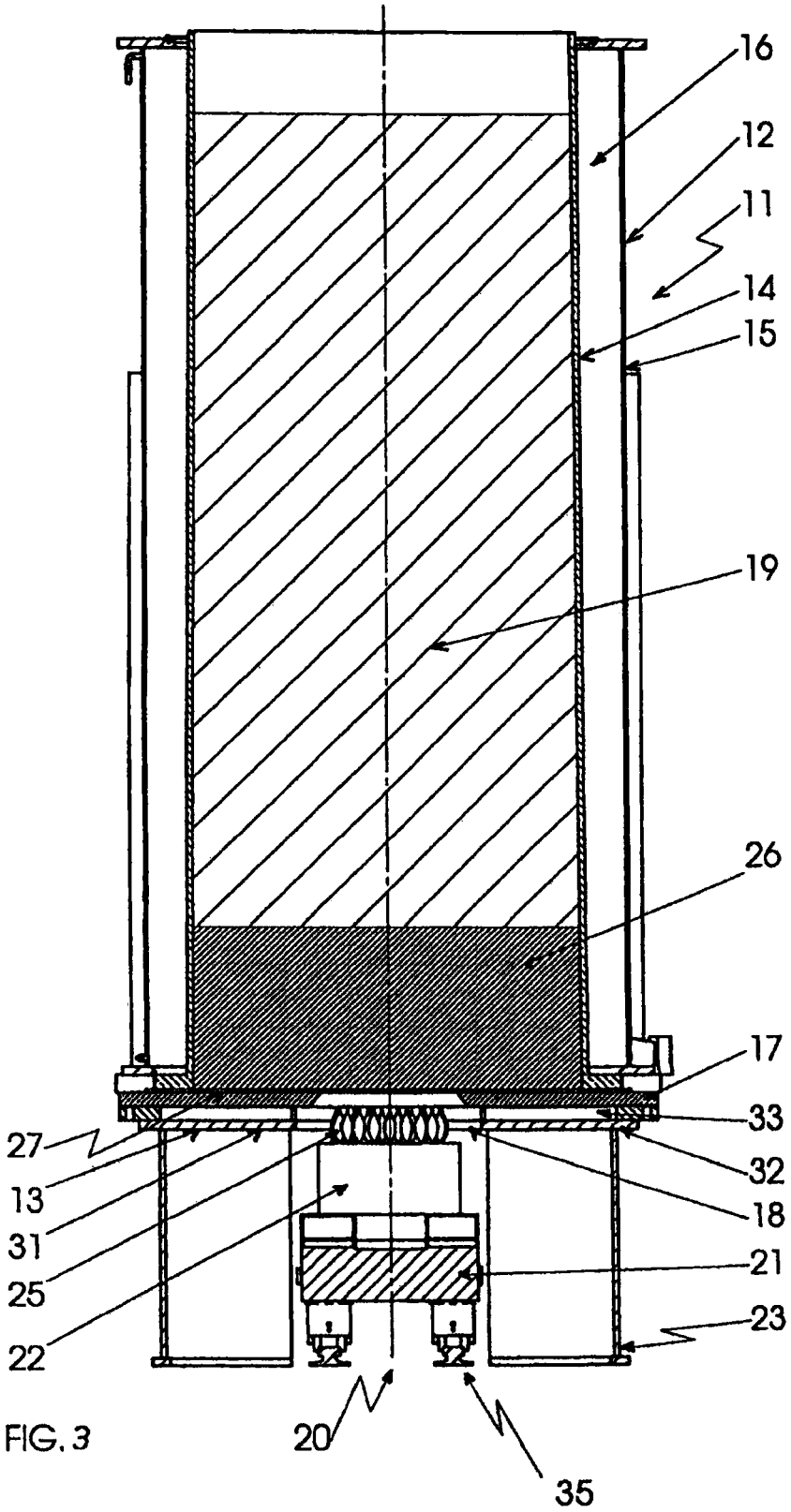
FIG. 3 shows a longitudinal section through the crucible apparatus according to FIG. 2.

FIG. 1 shows a crucible apparatus 10 of the type used on a not-shown electric furnace in the form of a stationary crucible system in electroslag remelting processes. FIG. 3, in particular, shows that the crucible apparatus 10 features a cup-shaped crucible pot 11 with a casing wall 12 and a crucible bottom 13. The casing wall 12 is realized in the form of a double wall with an inner pot wall 14 and an outer pot wall 15, between which a chamber 16 is formed that serves for accommodating a tempering medium such as, for example, water or oil.

The crucible bottom 13 features a bottom plate 17 that is provided with an opening 18 in its center. A heating device 20 with a burner head 22 of the heating device 20 in the form of a burner device which is arranged on an interchangeable carrier 21 of a changing device 35 is situated underneath the bottom plate 17 and in concentric alignment with a central longitudinal axis 19 of the crucible pot 11 in the heating configuration illustrated in FIG. 3.

In the heating configuration illustrated in FIG. 3, the heating device 20 is situated within a heating chamber 23 that is realized in the form of a substructure of the crucible pot 11 in this case.

FIG. 1, in particular, shows that the interchangeable carrier 21 is realized in the form of a chassis that is arranged on a rail arrangement 24 and can be displaced along the rail arrangement 24 from a cooling position according to FIG. 1 into a heating position according to FIG. 3, in which the burner head 22 is arranged underneath the opening 17 in such a way that an ingot base 26 or a face 27 of the ingot base 26 that is merely indicated in FIG. 3 can be directly acted upon with burner gas 25 as indicated with arrows in FIG. 3.

In contrast to the illustration according to FIG. 3, the heating chamber 23 may also be provided with doors in order to produce a process atmosphere that is independent of the surroundings within the heating chamber 23.

Figure 2:
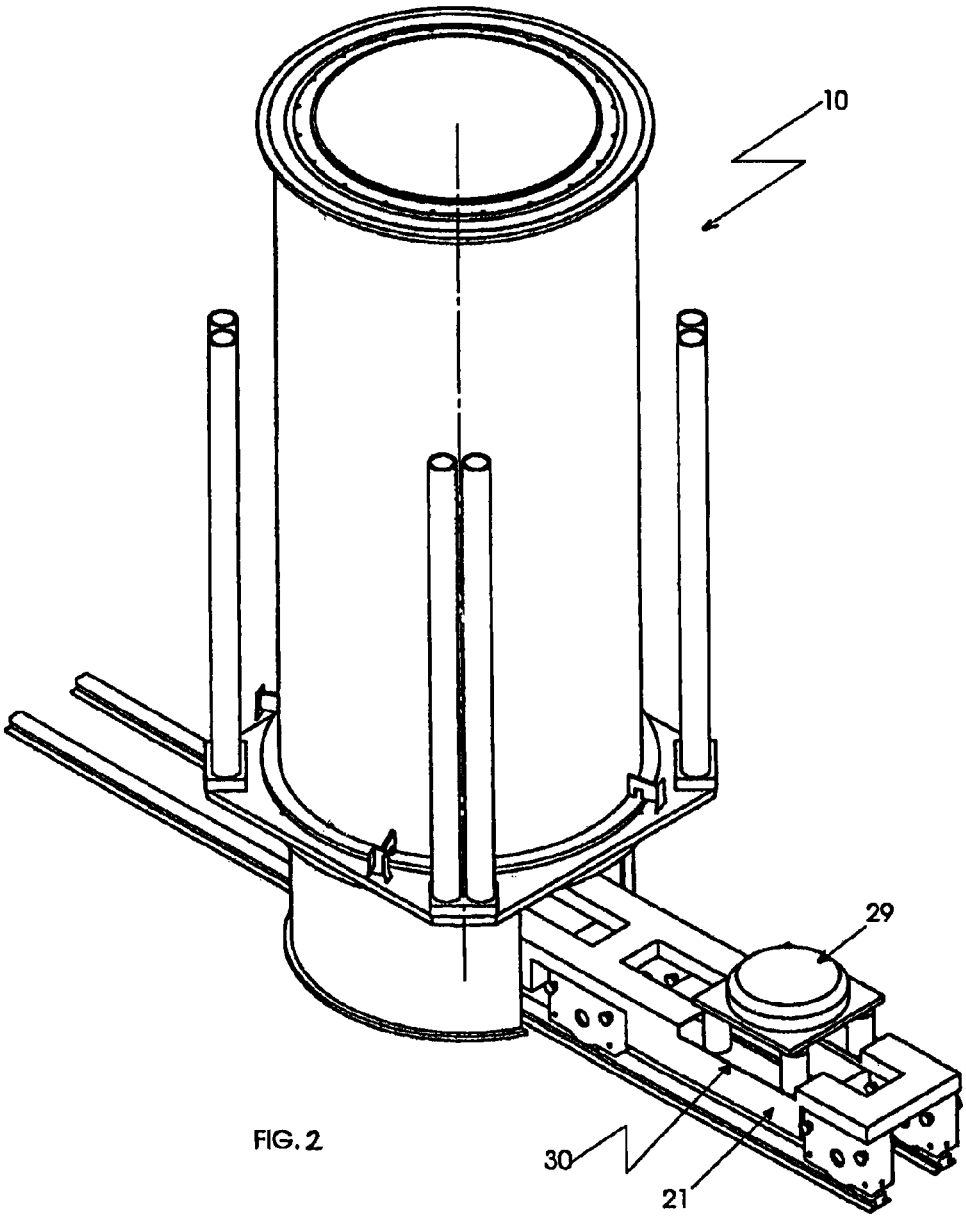
FIG. 2 shows the crucible apparatus according to FIG. 1 during the heating phase.

FIG. 2 shows a bottom closing plate 29 that is arranged in the opening 18 of the bottom plate 17 on the interchangeable carrier 21 of the changing device 35 instead of the heating device 20 during the cooling phase according to FIG. 1, wherein this bottom closing plate is arranged outside the crucible apparatus 10 during the heating phase. In order to close the opening 17 in the crucible bottom 13, the bottom closing plate 29 that preferably features a cooling device in order to promote the cooling process during the cooling phase is inserted into the opening 18 (FIG. 3) by means of a lifting mechanism 30 arranged on the carrier 21.

According to FIG. 3, the crucible bottom 13 is provided with a cooling device 31 in such a way that the bottom plate 17 defines an annular cooling or tempering chamber 33 around the opening 18 together with an essentially congruent wall plate 32. If so required, the cooling device 31 makes it possible to concentrate the heat supply even better on the central region of the ingot base 26.

The invention claimed is:

1. A method for remelting metal in an electric furnace, wherein molten metal of material electrodes solidify in ingot form in a crucible apparatus having a bottom plate, said method comprising:

cooling said molten metal in such a way that an ingot growth forms from an ingot base due to a progressive solidification process; and heating said ingot base in order to influence the cooling process by directly acting upon the ingot base with energy provided by interchanging a bottom closing plate of the bottom plate with a heating device, said closing plate and heating device being arranged on an interchangeable carrier movably arranged on a rail arrangement, wherein said bottom closing plate interchanges with said heating device by moving said interchangeable carrier on said rail arrangement.

2. The method according to claim 1, in which a face of the ingot base-is acted upon with energy.

3. The method according to claim 1, in which the ingot base is acted upon with energy from a burner device.

4. The method according to claim 1, in which electric energy is used for heating the ingot base.

5. The method according to claim 1, in which the ingot base is acted upon with a stream of a heat transfer medium.

6. The method according to claim 1, in which the ingot base is heated in such a way that a defined temperature distribution is adjusted over an ingot base cross section.

7. The method according to claim 1, in which the ingot base is heated in a reduced atmosphere.

8. The method according to claim 1, in which the ingot base is heated in a heating phase that follows cooling of the ingot base in a previous cooling phase.

9. The method according to claim 8, in which a change from the cooling phase to the heating phase takes place in dependence on an ingot base temperature measured by a temperature monitoring device.

10. A device for heating an ingot base of an ingot that solidifies during an electroslag remelting process as a result of cooling a molten metal of a material electrode, wherein the device comprising:

a crucible apparatus in which an ingot having an ingot base solidifies, said crucible apparatus having a casing wall and a crucible bottom that is provided with a heating device in order to heat the ingot base, wherein the crucible bottom is provided with an opening through which heating energy generated by the heating device is directly introduced into the ingot base, wherein the heating device and a bottom closing plate for closing the opening in the crucible bottom are arranged on a changing device that makes it possible to alternately position the bottom closing plate and the heating device on the crucible bottom, said changing device including an interchangeable carrier movably arranged on a rail arrangement, wherein the changing device alternately positions the bottom closing plate and the heating device by moving the interchangeable carrier on said rail arrangement.

11. The device according to claim 10, in which the heating device is a burner device.

12. The device according to claim 10, in which the heating device is a contact device.

13. The device according to claim 10, in which the heating device is a radiator.

14. The device according to claim 10, in which the heating device is a convection heater.

15. The device according to claim 10, in which the heating device is independent of the crucible bottom.

16. The device according to claim 15, in which the heating device is arranged in a heating chamber that is situated adjacent to the crucible bottom.

17. The device according to claim 16, in which the heating chamber is a process chamber.

18. The device according to claim 10, in which the bottom closing plate is provided with a cooling device.

* * * * *